United States Patent [19]

Donnay et al.

[11] Patent Number: 4,875,895

[45] Date of Patent: Oct. 24, 1989

[54] BUFFING APPARATUS FOR BOOK-FOLD CARTON; AND METHOD

[75] Inventors: James A. Donnay, Maplewood; Van E. Jensen, Jr., Stillwater; Bryon S. Kruzel, St. Paul, all of Minn.

[73] Assignee: Minnesota Mining and Manufcturing, St. Paul, Minn.

[21] Appl. No.: 168,896

[22] Filed: Mar. 16, 1988

[51] Int. Cl.[4] ..... B31B 1/72

[52] U.S. Cl. ..... 493/117; 156/522; 156/552; 493/78; 493/116; 493/347; 493/382

[58] Field of Search ..... 493/78, 116, 117, 347, 493/382; 156/521, 522, 552; 53/137

[56] References Cited

U.S. PATENT DOCUMENTS

| | | |
|---|---|---|
| Re. 26,440 | 8/1968 | Loveland et al. . |
| Re. 26,650 | 8/1969 | Loveland et al. . |
| 3,236,022 | 2/1966 | Loveland et al. . |
| 3,236,716 | 2/1966 | Loveland et al. . |
| 3,355,855 | 12/1967 | Loveland et al. . |
| 3,382,645 | 5/1968 | Loveland et al. . |
| 3,451,875 | 6/1969 | Loveland et al. . |
| 3,461,020 | 8/1969 | Loveland et al. . |
| 3,468,742 | 9/1969 | Loveland et al. . |
| 3,496,697 | 2/1970 | Loveland et al. . |
| 3,973,375 | 8/1976 | Loveland . |
| 4,004,401 | 1/1977 | Loveland . |
| 4,006,579 | 2/1977 | Loveland . |
| 4,026,090 | 5/1977 | Loveland . |
| 4,028,865 | 6/1977 | Loveland et al. . |
| 4,039,367 | 8/1977 | Warshaw et al. . |
| 4,041,675 | 8/1977 | Loveland et al. . |
| 4,061,526 | 12/1977 | Warshaw et al. . |
| 4,182,223 | 1/1980 | Warshaw et al. . |
| 4,238,270 | 12/1980 | Warshaw et al. . |
| 4,640,731 | 2/1987 | Lerner et al. . |
| 4,781,786 | 11/1988 | Lerner et al. . |

FOREIGN PATENT DOCUMENTS

| | | | |
|---|---|---|---|
| 0129094 | 12/1984 | European Pat. Off. | 493/116 |
| 432045 | 6/1975 | U.S.S.R. | 53/137 |
| 2120201 | 11/1983 | United Kingdom . | |

OTHER PUBLICATIONS

"Durable Modular 'do-it-all' Carton Sealing Systems" brochure, Durable Packaging Corporation (pp. 1–4) (not dated).

"Soco System" brochure, Soco System A/S, (pp. 1–8) (not dated).

"Little David" brochure, The Loveshaw Corporation (pp. 1–8) (not dated).

"Abal" brochure Abal Mfg. Inc. (pp. 1–13) (not dated).

"Fibre Box Handbook" excerpts, Packaging Corporation of America, (pp. 1–3) (not dated).

"Current Inc., Colorado Springs, Colorado" Sketches, 8–3–84.

"Haberman-built" device (photograph).

"Haberman-built" device (photograph).

"Haberman-built" device (photograph).

"North Star Graphics" device (photograph).

"North Star Graphics" device (photograph).

"North Star Graphics" device (photograph).

"3M-Matic 22A" brochure, 3M, (pp. 1–4) (not dated).

*Primary Examiner*—Robert P. Olszewski

*Assistant Examiner*—Robert Showalter

*Attorney, Agent, or Firm*—Merchant, Gould, Smith, Edell, Welter & Schmidt

[57] ABSTRACT

A buffing apparatus is provided for use in association with a case sealing arrangement, to buff lead and rear depending tape tails against a tape/carton combination. The buffing apparatus includes a single buffing member moved, by means of a motive mechanism, between paths and motion. The first path of motion is defined such that the buffing member is moved against a lead tape tail, and then is retracted so that a rear tape tail can pass thereover. The second path of motion is defined such that the buffing member is brought upwardly against the rear tape tail, to buff same into position, while returning the buffing member to the first extreme position. For preferred embodiments, the first and second paths of motion are identical, but opposite, to one another. In one embodiment, the paths of motion are defined by a cam track/follower arrangement. In a second embodiment, a link mechanism is described, which accomplishes a desired motion. The preferred link mechanism illustrated and described, includes: a triangular coupler link arrangement; a follower arm arrangement; and, an acute-angle input crank arm arrangement. The combination of link members define an advantageous path of motion for an engaged buffing member. A method of buffing lead in tape tails according to the present invention is also disclosed.

34 Claims, 8 Drawing Sheets

BUFFING APPARATUS FOR BOOK-FOLD CARTON; AND METHOD

FIELD OF THE INVENTION

The present invention relates to apparatus for sealing cartons or the like and in particular to apparatus for applying sealing tape to a shallow carton, with tape tails tucked or buffed underneath the carton. The invention particularly concerns a buffing unit or apparatus utilizable to smooth down depending tails of sealing tape, against a bottom portion of a shallow book-fold box, or the like, being sealed with a C-clip arrangement of tape.

BACKGROUND OF THE INVENTION

Corrugated fiberboard boxes or the like are widely utilized for the storage and shipping of a variety of materials. A frequently utilized design for the construction of such boxes involves an arrangement wherein: the box has four sides; and, four flaps are provided at opposite ends of the box, each set of four flaps comprising two pair of opposite flaps. Typically, during sealing the pairs of flaps are folded toward one another in such a manner that an elongate seam is provided across both the top and bottom portions of the box. In sealing such boxes, adhesive tape is generally extended longitudinally along a seam to be sealed. Typically, an extension of tape somewhat longer than the seam is used, and the tape extension is wrapped over end panels of the box, for securement. In general, such end extensions of tape are usually at least about 2–4 inches (5–11 cm) long, so that a secure adhesive engagement with a relatively significant side or end surface area of carton is obtained. In many situations such sealing arrangements of adhesive tape are applied to both the top and the bottom of a carton.

Automatic apparatus have been developed to accomplish application of sealing tape in the above manner to conventional, relatively deep, boxes or cartons of the type described. Typically, for such arrangements, the boxes are fed into the apparatus end-wise, so that a tape head or applicator applies the tape: first to a lead side (or end) of the box; then across either the top or bottom of the box to seal a seam by extension to the opposite side or end; and, finally, somewhat down the opposite (rear) side (or end). Some conventional arrangements provide for application of tape to both top and bottom surfaces of the carton being sealed.

Conventional arrangements have worked quite well, for application to relatively deep cartons. One such commercial arrangement is available from the Assignee of the present invention, Minnesota Mining and Manufacturing Corporation, St. Paul, Minn., under the tradename 3M-Matic TM 22A Adjustable Case Sealer.

Some carton designs, however, although frequently used are not susceptible to good secure sealing via the above methods, and with such conventional apparatus. One such style of carton is the "book-fold" carton. This type of carton is generally very shallow, usually about 0.25–3.0 inch (0.6–7.5 cm) deep, and includes only one seam for sealing. A representative conventional book-fold carton is depicted at reference numeral 1, FIG. 1.

As used herein the term "book-fold carton" shall be understood to refer to any carton which is closed by folding laterial flaps together, over a unitary back panel. Such a carton has an open seam on the top, but none on the bottom. The book-fold carton of FIG. 1 is a one-piece carton. Two- and three-piece book-fold cartons are also known, see for example "Fiber Box Handbook", Packaging Corporation of America, p. 44, incorporated herein by reference. Multi-piece arrangements may be sealed according to the principles of the present invention, discussed in detail below.

At reference numeral 2, FIG. 2, carton 1 as shown have been sealed by means of a conventional arrangement of tape 4. An important difference exists between: the manner and arrangement by which adhesive tape 4 is applied to book-fold carton 1; and, the way such tape is applied to conventional, relatively deep, cartons. First, as previously indicated, for the book-fold carton the only longitudinal seam which needs to be sealed is that on surface 5 of the box, i.e. the seam indicated in phantom at numeral 6. That is, there is no analogous seam on a bottom side of the box. Thus, only one extension of tape 4 is needed to accomplish the sealing. A second important difference between sealing of a shallow carton 1, and deep cartons, is that at end surfaces 10 and 11, insufficient depth of surface is provided for good securement of the adhesive tape 4. As a result, end tabs, flaps or tails 15 of tape 4 are usually folded underneath carton 1, and are smoothed out (or buffed) in attachment to a surface (typically bottom) of the carton 2 opposite to surface 5. This type of tape arrangement is generally designated in the carton industry as a "C-clip".

In the production of "C-clip" folds of tape, it is necessary to provide a method whereby tails 15 can be buffed against, i.e. smoothly applied against, the surface of the carton 1, to which they are shown adhered in FIG. 2. A variety of means have been developed to accomplish this. None has been completely satisfactory. Problems have generally concerned: speed of the buffing steps; effective obtaining of a smooth, flat, wrinkle-free profile for the tails 15; development of mechanized systems to accomplish C-clip application relatively rapidly and efficiently; and, similar matters.

What has been needed has been an apparatus to accomplish the "buffing" or "smoothing" step of application of tape tails, especially those of the C-clip, wherein the short tails, tabs or extensions of tape eventually located on an opposite side of the carton from the seam being sealed, are smoothed and pressed (or buffed) into position. What has particularly been needed has been an apparatus for effecting this, in accomplishment with otherwise conventional or modified conventional carton or case sealing arrangements. A method for accomplishing such buffing of tails of tape, preferably by means of such an apparatus, has also been needed.

SUMMARY OF THE INVENTION

A buffing apparatus is provided for use in buffing first (lead) and second (rear) depending tape tails of a tape/-carton arrangement. Preferably the arrangement is used to form a C-clip seal on a book-fold carton. The apparatus includes a moveable buffing member, and a system or motive means for directing movement of the buffer member in a preferred manner, to accomplish the desired buffing. More specifically, means are provided so that the buffing member is selectively moved along a path or paths of motion between first and second extreme positions. When moving from the first to the second extreme position, the buffing member is initially directed into a first or lead tape tail, and presses same against a carton to be sealed. In further movement toward the second extreme position, the buffing member is retracted out of possible engagement with the tape/carton arrangement or combination. More specifically, the buffing member is retracted beneath the rear tape tail, which then passes thereover. Once the tape/carton arrangement is moved to an appropriate position, the buffing member is selectively returned from the second extreme position to the first extreme position, preferably along a path of motion identical, but opposite, to movement from the first to the second extreme position. This results in buffing of the second (rear) tail of tape against the carton.

The preferred buffing apparatus generally includes: a moveable buffing member; guide or motive means for directing movement of the buffing member in an appropriate and selected manner; and, actuator means to generate selective movement of the buffing member. In many preferred embodiments, a sensor/switch mechanism constructed and arranged to sense an appropriate moment at which to fire the motive means, to cause movement of the buffing member, is included. For the preferred embodiment the sensor/switch mechanism comprises a sensor positioned in the path or plane of motion of a carton/tape combination to be sealed.

The buffing member preferably comprises a roller of appropriate size and width to press tape tails against an underside of a carton/tape combination to be buffed.

The guide mechanism or motive means, for one preferred embodiment, includes a cam track oriented to provide for selective movement of the buffing member between the first and second extreme positions; the first extreme position having the buffing member oriented for engagement with an underside of a carton/tape combination in the plane of motion thereof; and, the second extreme position having the buffing member retracted generally beneath a carton/tape combination and out of position for possible engagement therewith. As previously suggested, preferably the motive means includes such a guide mechanism providing for movement of the buffer member between the first and second extreme positions in a preferred manner, whereby in moving from the first to the second extreme position: the buffing member buffs a first or lead tail of the carton/tape combination against a bottom side thereof and then is retracted; and, in moving from the second extreme position to the first extreme position, the buffing member buffs a rear tail of the carton/tape combination against a bottom side thereof.

In the first preferred embodiment, the buffing member comprises a roller mounted in mount arrangement preferably comprising a yoke. The apparatus includes a double-acting piston and cylinder arrangement, oriented for selective movement of the yoke arrangement. The motive means or mechanism generally includes a cam track oriented appropriately with respect to a conveying surface and for a carton/tape combination to be buffed. Preferably, the yoke includes a follower means for engagement with a cam track. Also, preferably the sensor/switch mechanism comprises a trip switch located in a surface or plane of movement of carton/tape combinations to be buffed.

Also according to the present invention an operative combination is provided including: a buffing apparatus; motive means for moving cartons to be buffed through the combination; guide means for directing cartons to be buffed in a preferred manner through the arrangement; and, tape application means for applying tape to cartons, to generate preferred carton/tape combinations for buffing with the buffing apparatus.

According to an alternate embodiment, the motive means includes a link mechanism appropriate to generate selected, preferred, movement of the buffing member. A preferred such arrangement which uses a central, triangular, link arrangement is described.

The prefered link arrangement includes: a triangular coupler link arrangement; a follower link arrangement; and, an input crank arm arrangement. The triangular coupler link arrangement defines first, second and thrid vertices. A buffing member is mounted at the first vertex. The follower link arrangement anchors the second vertex to a ground point. The input crank arm is pivotally mounted to a ground point, and also to the third vertex. Selected movement of the crank arm, as described below, directs controlled movement of the buffing member along selected paths of operation. Movement, for the preferred embodiment, is generated by a piston and cylinder arrangement.

Also according to the present invention a method is provided whereby first (lead) and second (rear) tape tails of a carton/tape combination can be buffed to form a C-clip seal, for example around a book-fold carton or the like. The method includes provision of a buffing member and movement thereof to: first buff a lead tape tail; then retract same beneath a rear tape tail; and, then raise the buffing member to buff the rear tape tail.

The drawings constitute a part of this specification and include exemplary embodiments to the present invention, while illustrating various objects and features thereof. It is to be understood that in some instances relative component sizes and material thicknesses may be shown exaggerated, to facilitate an understanding of the principles of the invention.

BRIEF DESCRIPTION OF THE DRAWINGS

FIG. 8 is a fragmentary schematic view of a step of applying an extension of tape to a book-fold carton or the like.

FIG. 9 is a schematic view of a step of applying extension of tape to a book-fold carton or the like; FIG. 9 being a step in the application which follows the step illustrated in FIG. 8.

FIG. 10 being a step which follows, in progression, the steps illustrated in FIGS. 8 and 9 respectively.

FIG. 15 being illustrative of a stage of operation to buff a trailing end of tape against a bottom portion of a carton shown in operative association therewith.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but rather as a basis for the claims and as a representative basis for teaching one skilled in art to variously employ the present invention in virtually any appropriately detailed structure or system.

Figure 1:
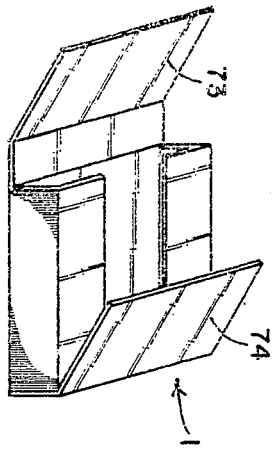
FIG. 1 is as a perspective view of a conventional book-fold carton, shown prior to closing for sealing.
Figure 2:
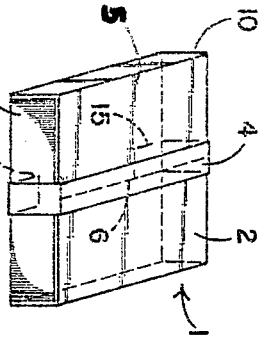
FIG. 2 is a perspective view of the book-fold carton illustrated in FIG. 1, but shown closed and sealed with a C-clip extension of tape thereon.

As previously indicated, in FIG. 1 a carton 1, to be sealed according to the present invention, is illustrated prior to having a C-clip extension of tape applied thereto. In FIG. 2, an analogous carton 2 is depicted with a C-clip of tape 4 thereon. In FIG. 2, tape feet, extensions or tails 15 are shown buffed against the bottom of the carton 2. According to the present invention, an apparatus is provided to accomplish buffing or smoothing of tape tails 15 into place, as indicated.

Figure 3:
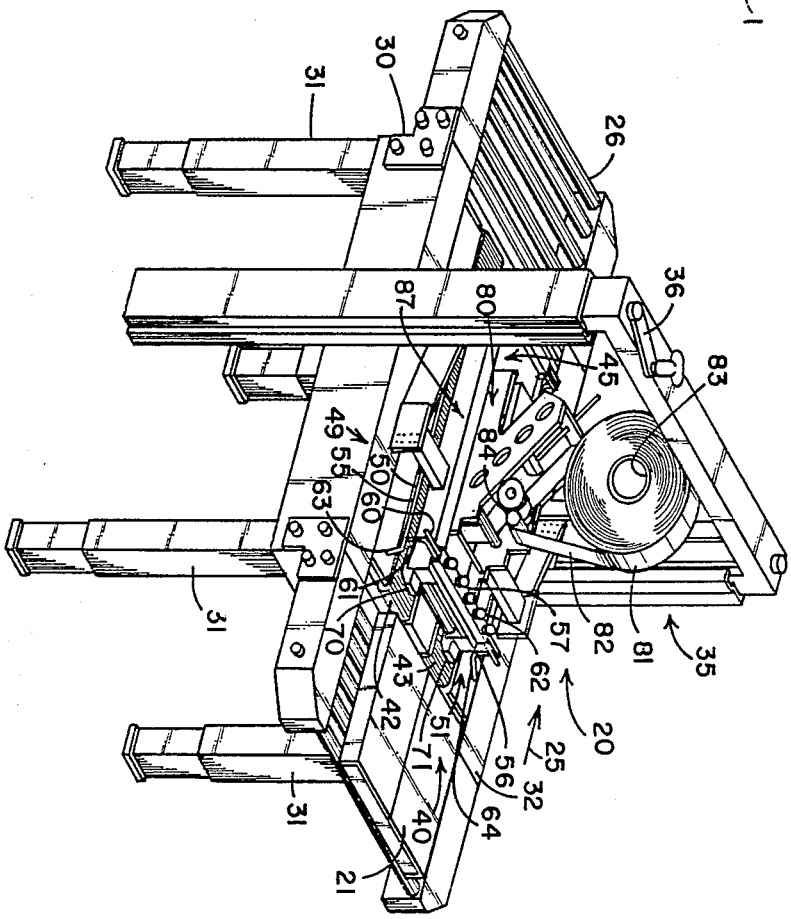
FIG. 3 is a perspective view of a carton sealing apparatus modified with a buffing apparatus according to the present invention, for buffing of the C-clip arrangement into position.

Referring to FIG. 3, an overall apparatus 20 is depicted for accomplishing sealing and buffing according to the present invention. A book-fold carton 21 is depicted in operative combination with apparatus 20. Typically, carton 21 is fed through apparatus 20 in the general direction indicated by arrow 25. In the apparatus 20, tape is applied to the carton 21, and the tape is buffed according to the present invention. From end 26 of the apparatus 20, a carton having a C-clip thereon, as shown in FIG. 2, would be removed.

The apparatus 20 depicted in FIG. 3 is intended to be representational only of an apparatus which may include a buffing apparatus therein, according to the present invention. The specific apparatus 20 depicted in FIG. 3 includes many components analogous to those found in a conventional 3M-Matic TM 22A Adjustable Case Sealer, an apparatus specifically designed for the sealing of relatively deep cartons. More particularly, the apparatus 20 depicted generally comprises a modified 3M-Matic TM 22A device. The major modifications concern introduction of components of a buffing apparatus according to the present invention, and as illustrated in FIGS. 4, 5, 12, 13, 14 and 15 or alternatively FIGS. 16–22. Other modifications to a 3M-Matic TM 22A device, to achieve the device 20 of FIG. 3, generally involve modifications of existing components, to accommodate the buffing apparatus itself. Some of these modifications will be described below in detail.

Still referring to FIG. 3, device 20 includes: a frame arrangement; motive means actuating movement of a carton 21 therethrough; guide means for orienting a carton 21 moving therethrough in a selected manner; tape application means for applying tape to a carton moving therethrough, in a preferred manner; and, a buffing apparatus according to the present invention.

Still referring to FIG. 3, the frame means comprises a frame mechanism 30 including adjustable legs 31, table 32, and support assembly 35. The support assembly 35 suspends certain working elements, including the guide means and tape application means, in an appropriate, operative, position over table 32. The support assembly 35 is preferably vertically adjustable by a screw-jack arrangement, not shown, actuated by means such as crank 36, to provide ease of access for maintenance, cleaning, adjustment for different sized cartons or the like, etc.

The motive means comprises a conveyor system 40 preferably having first and second, spaced, parallel, synchronized, conveyor belts 42 and 43. The conveyor belts 42 and 43 are spaced such that a carton 21 resting thereon, can be selectively moved therealong in the direction of arrow 25, for passage through selected portions of apparatus 20. A conventional drive arrangement, not shown, can be used for selective driving of belts 42 and 43, in a synchronized manner. Preferably belts 42 and 43 are spaced apart a sufficient amount to accommodate application of tape to carton 21, in a preferred manner, and also to accommodate a buffing apparatus according to the present invention, as described below.

It is noted that the buffing apparatus of the present invention is not viewable in the perspective shown in FIG. 3, as it is hidden from view by various portions of apparatus 20. It is located generally underneath portions indicated at arrow 45.

The guide means for the arrangement depicted in FIG. 3 generally comprises a guide mechanism 49 including a rail framework 50 and a cam arrangement 51. The rail framework 50 includes first and second opposite side rails 55 and 56 and a horizontal adjustment arrangement 57. Preferably the rails 55 and 56 are adjusted to a spacing apart from one another, such that each will be positioned along, and adjacent, opposite sides of a carton 21 passing therebetween. The horizontal adjustment arrangement 57 comprises horizontal extensions 60 and 61 on rail framework 50, adjustably received within a channel and locked therein by locking bolts 62. By such means, adjustment of spacing between rails 55 and 56 is readily accomplished, in a selected manner. Thus, cartons 21 of different width can be readily accommodated by apparatus 20. First ends 63 and 64, of rails 55 and 56 respectively, include outward cam extensions, to help center cartons 21 passing therebetween.

The rail framework 50 is adapted for relatively shallow, wide, cartons such as box-fold carton 21. The framework 50 is also developed to be suspended, by means of support assembly 35, over table 32. The assembly is specifically adapted to position rails such as narrow rails 56 and 57, along side edges of a relatively wide, shallow, carton such as carton 21.

Still referring to FIG. 3, the guide means includes a cam arrangement 51 thereon, providing for secure engagement with cartons 21, pressing same closed and into the conveyor system 40. For the embodiment illustrated in FIG. 3, the cam arrangement 51 comprises first and second cams 70 and 71, supported at an appropriate height, and with appropriate lateral spacing, to engage the carton 21 and gently press same downwardly into the conveyor. Cams 70 and 71 ensure that flaps 73 and 74, FIG. 1, on the carton 21 will be pressed closed while the tape is applied. The cam arrangement 51 is mounted on the support assembly 35, so that its vertical height is adjustable by means of the height adjustment crank 36. Thus, the cams 70 and 71 can be adjustably positioned for engagement with a variety of sizes of cartons 21.

Still referring to FIG. 3, apparatus 20 includes a tape application means. The tape application means may be of a variety of conventional types of tape heads, or types yet to be developed. Generally the tape application means comprises a dispenser/feed/cutting arrangement 80 constructed and arranged to apply adhesive tape to a carton, in a manner providing for first (lead) and second (rear) tails or extensions of tape on a carton/tape combination. The arrangement 80 includes a feeder roll 81 of tape 82. A variety of conventional tapes may be utilized including, for example, standard 2" or 3" (5 or 7.6 cm) sealing tapes such as Scotchbrand TM 371,375 or 355 tape (3M, St. Paul, Minn.). Typically, what is required is a tape which includes adhesive on only one side thereof, and which readily adheres on contact. The feeder roll 81 is mounted upon axle arrangement 83, for ease of feed.

The tape 82 is fed from the feeder roll 81 through a feed system which may comprise a plurality of director-/idler rollers, such as rollers 84, until the tape is oriented appropriately for engagement by a carton 21 like passing through the assembly 20. Direction, support and selective cutting of the tape 82 is provided by a feed/-cutter assembly 87. A variety of feed/cutter assemblies, including ones yet to be developed, may be utilized. An example of a conventional such assembly, modified for use in the present application, is indicated in FIGS. 6 and 7.

Figure 6:
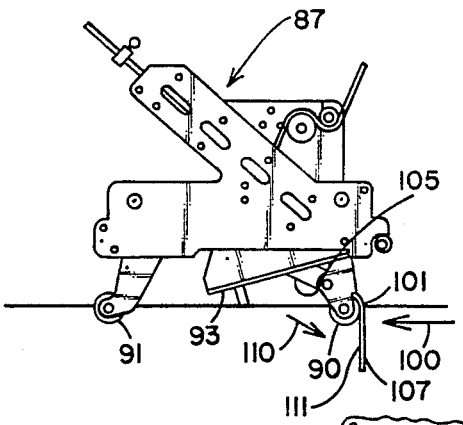
FIG. 6 is an enlarged side elevational view of a component of the assembly illustrated in FIG. 3.
Figure 7:
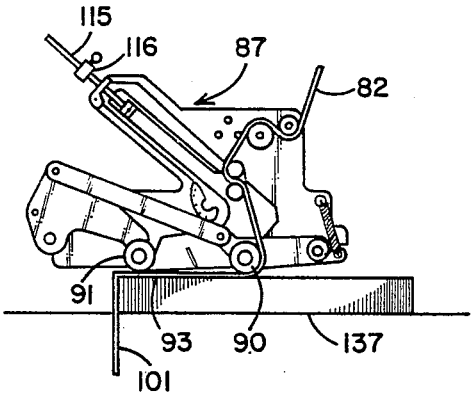
FIG. 7 is a schematic view of the component shown in FIG. 5, depicted in operation, and with internal portions detailed.

Referring to FIG. 6, assembly 87 includes a front applicator roller 90, a rear roller 91 and a knife blade or cutter arrangement 93. The assembly 87 depicted in FIGS. 6 and 7 is generally a conventional one utilized for the 3-Matic TM 22A Adjustable Case Sealer, shown modified in three significant manners. These will be explained in further detail below.

Generally a carton or the like approaches assembly 87 in the general direction indicated by arrow 100. The carton first engages the lead roller 90, pressing extension of tape 101 between a side or end surface of the carton and the roller 90. In conventional case sealer arrangements, the extension 101 of tape does not hang (as shown) substantially below roller 90, rather it terminates within the diameter of roller 90. As the carton presses against roller 90, with tape 101 therebetween, the tape adheres to the front side of the carton; i.e. the tape extension 101 is oriented such that the adhesive side faces cartons moving thereagainst.

As the carton is further pressed into the roller 90, by the conveyor system, linkage assembly 105 permits the roller 90 to be retracted, and lifted upwardly. At the same time, the knife blade arrangement 93 is lifted by contact with the carton, FIG. 7. As the carton continues in its motion, roller 90 rolls across an upper surface of the carton, dispensing tape 101 against the upper surface of the carton. Eventually the carton will reach the second roller 91, lifting same. The second roller buffs or smoothes out the tape, as it rolls across the carton. The front roller 90 will eventually move a rear end of the carton, still feeding out tape 101. Eventually, the knife blade 93 is dropped to cut the tape 101. When the rear roller 91 reaches the rear end of the carton, it will drop off same, buffing the tape 101 against a rear end of the box.

Again, for conventional uses of an assembly 87, for example to seal deep cartons, a tape extension suspended downwardly from roller 90 a significant extent, is not necessary. The reason for this is that the roller 90 would typically be positioned at a height to engage a front end of the carton, to be sealed, at about 2–4 inches (5–11 cm) below an upper surface of the carton. With a shallow book-fold type carton, such as a carton 21, however, a tail 107, FIG. 6 hanging downwardly from roller 90, is necessary so that an extension of tape, eventually to be folded under such as tail 15, FIG. 2, will be left on the lead end of the carton. Thus, one of the major modifications to use of assembly 87 in applications according to the present invention, is that it is adjusted to provide for such an extension 107.

A second modification of arrangement 87 over conventional applications of such an arrangement is that means are provided to direct a continual, moderate, stream of air in the general direction of arrow 110, against a back, non-adhesive, side 111 of tape extension 107. The stream of air ensures that tape extension 107 hangs rather freely, directed primarily downwardly, and is not pulled back against and around surfaces of roller 90. In the absence of such an air stream, attractive static forces would be likely to cause such a curling of extension or tail 107. It will be understood that a variety of means may be utilized for the direction of the air flow against the rear side 111 of the tape 107. Generally, a conventional air-directing hose and nozzle arrangement, with appropriate valve means to adjust pressure, may be utilized.

Another manner in which assembly 87 has been substantially modified from conventional use, to accommodate mounting an assembly 20 according to the present invention, is that the rollers 90 and 91, are mounted on an adjustable mount arrangement so that they can be lowered with the front and rear rollers 90 and 91 oriented to be engaged by the front end or wall of a vary shallow carton or box, such as book-fold carton 21. Typical, conventional, tape heads used with case sealers such as the 3M-Matic TM 22A do not include means for such a low adjustment of the rollers 90 and 91, because such devices are not designed for use with such shallow boxes. The particular mechanical arrangement utilized to permit adjustment of the height of rollers 90 and 91, for assembly 87, is not detailed. Generally, guide rod 115 includes a slide mount 116 thereon, whereby operating height of rollers 90 and 91 can be adjusted. In FIG. 7, threading of tape 82 through arrangement 87, for application to a carton 112 is depicted.

As previously indicated, the present invention concerns a buffing arrangement which is utilized to press tape flaps underneath a book-fold type carton, after a dispenser/feed/cutting arrangement has been utilized to apply tape to the carton in an appropriate manner, to yield a tape/carton (or carton/tape) combination. The specific arrangement utilized to apply the tape is not critical, although the previously described features do yield an advantageous system for use in cooperation with a buffing arrangement according to the present invention. What is generally required, is a system which can appropriately apply an extension of tape to a shallow carton or the like, and which leaves depending extensions hanging therefrom that can be folded underneath the carton, for example to generate the C-clip arrangement illustrated in FIG. 2. Such an application of tape will understood by reference to FIGS. 8, 9, 10 and 11.

Figure 8:
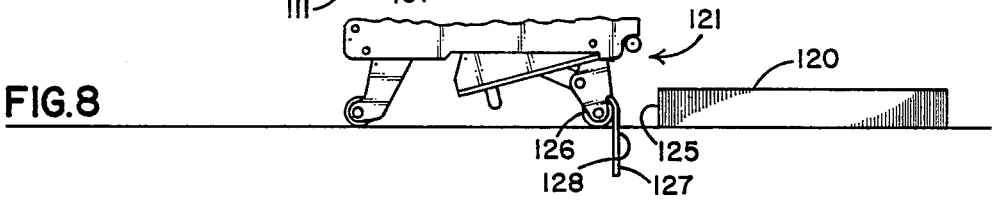

Referring to FIG. 8, a shallow carton 120 is shown directed against a dispenser/feed/cutting arrangement illustrated schematically at 121. In particular, the carton 120 is shown directed so that its lead end 125 is oriented to engage lead roller 126, with tape 127 therebetween. It will be understood that lead roller 126 may be analogous to roller 90, FIG. 6, and tape 127 may be analogous to tape extension 101. Generally, tape extension 127 is sized such that it extends at least about 2–4 inches (5–11 cm) below the bottom surface of shallow carton 120. The tape 127 is also oriented so that its adhesive side 128 will be engaged by carton 120.

Figure 9:
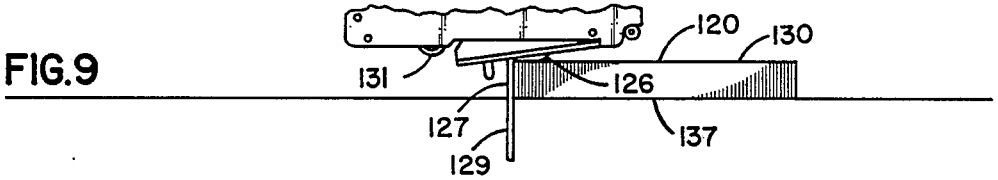

Referring to FIG. 9, the carton 120 is shown part way through the dispensing operation. Roller 126, it will be understood, has been engaged and lifted by the lead end 125 of carton 120. A lower 2–4 (5–11 cm) inch extension or tail 129 of tape has been left extending downwardly from the carton 120. The tape 125 is shown being applied across an upper surface 130 of the carton 120, by the arrangement 121. Specifically, roller 126 is shown pressing tape 127 against carton surface 130. Generally, it will be understood that for typical applications the carton 120 is oriented relative to the lead roller 126 such that the tape 127 will be positioned approximately symmetrically over the central open seam in the carton 120, i.e. the seam analogous to seam 6, FIG. 2.

Figure 10:
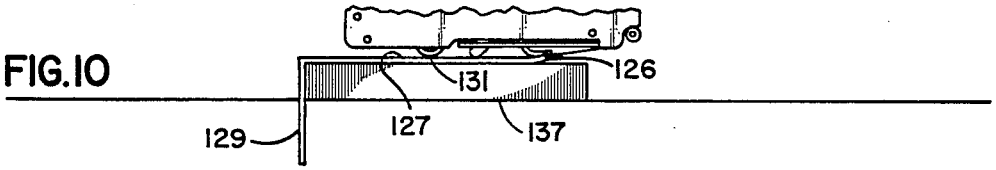
FIG. 10 is a fragmentary schematic view of a step of applying an extension of tape to a book-fold carton.
Figure 11:
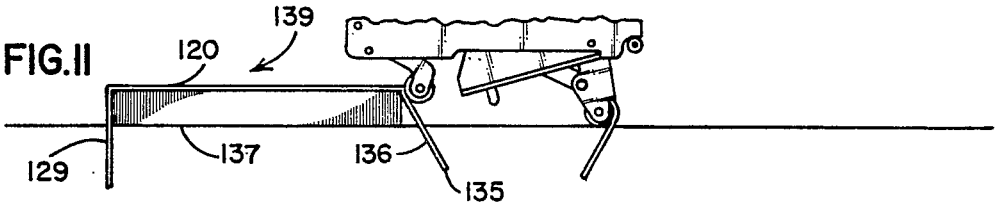
FIG. 11 is a schematic view depicting a still later step following FIGS. 8, 9 and 10.

In FIG. 10, the carton 120 is shown having passed completely beyond rear roller 131. Roller 126 is shown still feeding tape, to form a rear extension or tail. It will be understood that if the cutting arrangement were designed to eventually cut tape 127 at about the point indicated by reference numeral 135, FIG. 11, a carton/-tape combination would result which has a lead tail 129 and a rear tail 136 hanging downwardly therefrom. All that would be necessary to form the C-clip of FIG. 2, would be operation of the buffing device according to the present invention to fold flaps 136 and 129 against the lower surface 137 of box 120. In FIG. 11, the carton/tape combination 139 is depicted so prepared.

Figure 4:
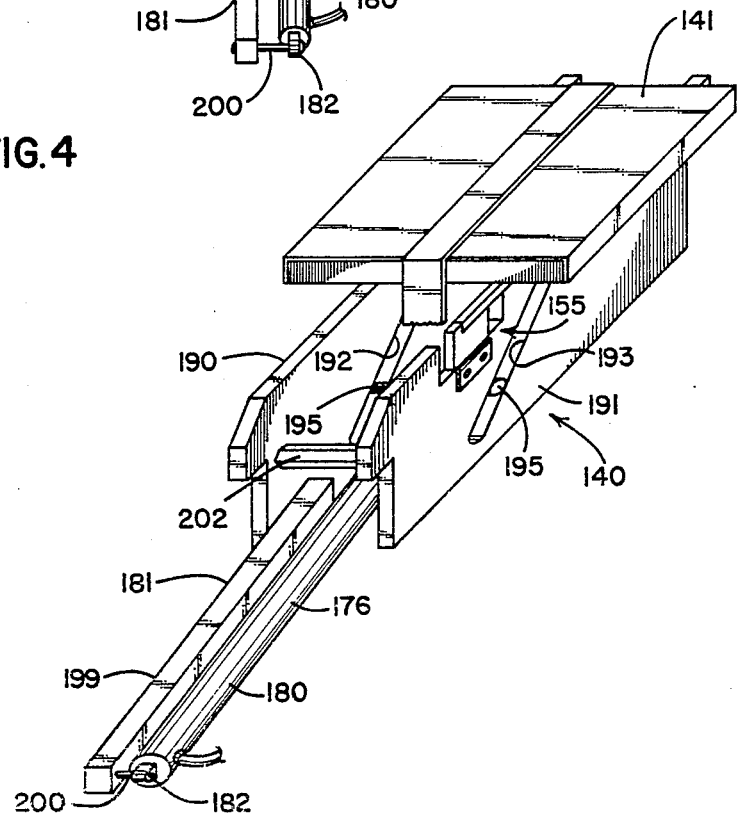
FIG. 4 is an enlarged perspective view of a buffing apparatus component of the arrangement shown in FIG. 3, depicted schematically with a carton in association therewith, during a step of buffing.

Referring to FIG. 4, a buffing arrangement or device according to the present invention is indicated at reference numeral 140. A carton/tape combination prepared to be buffed with device 140 is indicated generally reference numeral 141. Principles of operation of the buffing arrangement 140, to provide the C-clip arrangement illustrated in FIG. 2, will be understood by reference to FIGS. 12–15.

Figure 12:
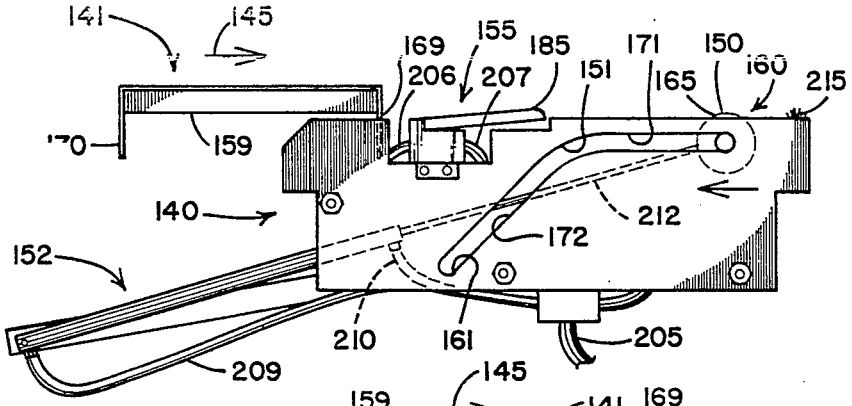
FIG. 12 is a partially schematic, side elevational view, of a buffing apparatus according to the present invention, shown about to receive a book-fold carton having an extension of tape thereon, in operative association therewith for buffing of tape extensions against a bottom side thereof.
Figure 13:
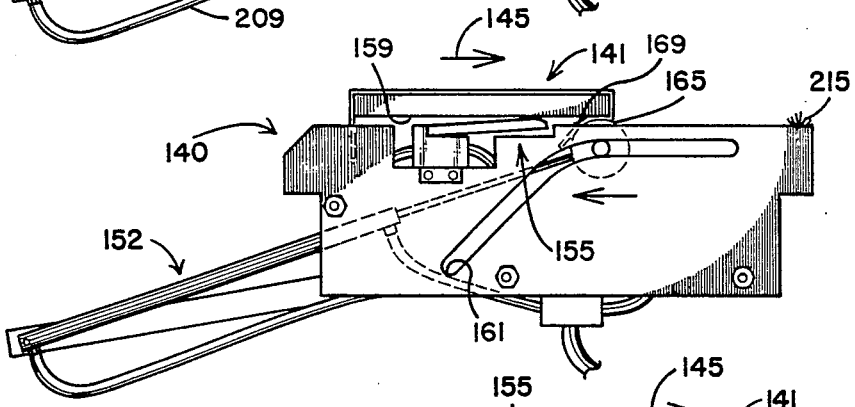
FIG. 13 is a schematic view of buffing apparatus generally corresponding, to FIG. 12, but shown during operation to buff a leading extension of tape, against an underside of a carton in association therewith.

Referring to FIG. 12, in use the buffing apparatus 140 is operatively positioned in an apparatus such as assembly 20, FIG. 3, so that it is approached by a carton/tape combination 141 moving (for example on a conveyor system FIG. 3) in the general direction indicated by arrow 145, in a plane of movement. Buffing apparatus 140 generally includes a buffing member 150, mounted for appropriate movement between first and second extreme positions.

The apparatus 140 is such that as buffing member 150 is moved from a first extreme position to a second extreme position, it buffs a lead tail of tape into position against a carton moving in the path of arrow 145. To accomplish this, the buffing member 150 is moved generally toward the combination 141, at a height for engagement with an underside thereof. Further, apparatus 140 is such that in moving from the second extreme position to the first extreme position, the buffing member can selectively buff a rear tape tail against a carton moving in the path indicated by arrow 145.

For the embodiment depicted in FIGS. 12–15, the buffing member 150 is mounted for appropriate movement between the first and second extreme positions, by means of engagement with a cam track 151. The cam track 151, as will be understood from the further detailed descriptions, defines paths of motion between the first and second extreme positions, and limits movement of the buffing member 150 to the defined paths of motion. For the embodiment of FIGS. 12–15, the path of motion from the first extreme position to the second extreme position is identical to, but opposite, the path of motion from the second extreme position to the first extreme position.

A buffing member motive mechanism 152 is provided, to generate selective movement of the buffing member 150 as described below, to generate buffing of tape on a selected carton. The arrangement 140 also includes an actuator mechanism including a sensor/-switch mechanism 155 oriented to selectively control the motive mechanism 152, as described.

In general, what is required is an arrangement such as a cam track 151 appropriately constructed and arranged for directing movement of the buffing member 150, in a preferred manner, between the first and second extreme positions. The first extreme position comprises a position whereat the buffing member 150 is oriented for engagement with a bottom side 159 of a carton/tape combination 141 moving across the assembly 140. The second extreme position for the buffing member 150 is upstream with respect to the conveying direction, i.e. the direction indicated by arrow 145, and is substantially recessed relative to the level at which the bottom surface 159 of combination 141 moves across the assembly 140. In FIG. 12, the buffing member 150 is depicted at the first extreme position 160.

Still referring to FIG. 12, it will be understood that preferably the buffing member 150 comprises a roller 165. Preferably roller 165 is formed with a somewhat resilient, outer surface to facilitate buffing without damage to the carton/tape combination 141. In operation, FIG. 13, as the carton/tape combination 141 moves in the direction of arrow 145, sensor/switch mechanism 155 is engaged. At this point, the motive mechanism 152 is actuated in response to the sensor/switch mechanism 155, to retract buffing member 150 along cam track 151. In so doing, buffing member 150 engages a front tail 169 of tape, and presses same against the lower surface 159 of combination 141; i.e. buffing member 150 buffs the front flap of a C-clip into position by movement toward the tape/carton combination 141. After this initial buffing, the actuator mechanism 152 continues to retract the buffing member 150, preferably steeply downwardly to the second extreme position 161, whereat the buffing member 150 is retracted well beneath surface 159, and in particular beneath the rear tail 170 of tape in the carton/tape combination 141. Controlled motion of buffing member 150 is accommodated by the described cam track/follower arrangement.

Thus, cam track 151 can be viewed as having first and second joined segments; first segment 171 extending in general alignment with the path of motion 145 for engagement with the carton/tape combination 141, as shown; and, the second extension 172 depending substantially from the path of motion 145, to provided for retraction of buffing member 150 well beneath the carton/tape combination 141.

Figure 14:
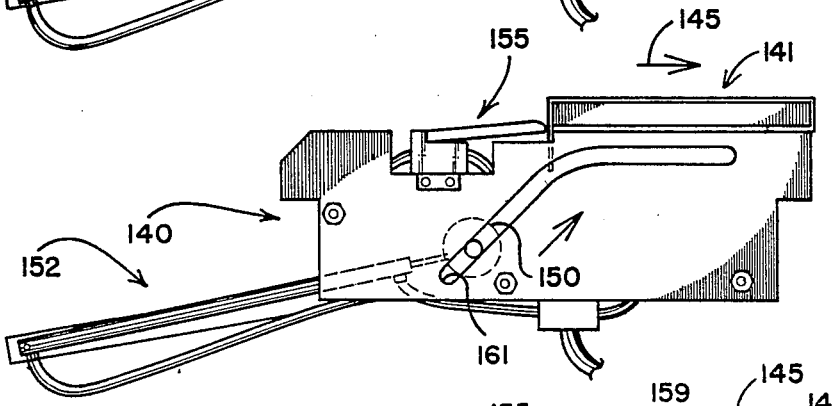
FIG. 14 is a partially schematic side elevational view of a buffing apparatus generally corresponding to FIG. 13, but illustrated during a stage of operation following the stage illustrated in FIG. 13.
Figure 15:
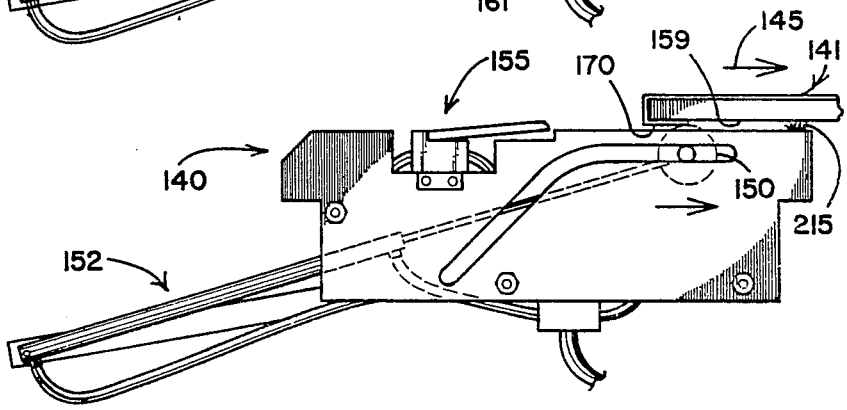
FIG. 15 is a partially schematic side elevational view of a buffing apparatus corresponding generally to the apparatus depicted in FIG. 14.

During operation, the carton/tape combination 141 continues to be conveyed in the general direction of arrow 145, FIG. 14. Eventually combination 141 releases the sensor/switch mechanism 155, which is adjusted to signal when rear tail 170 has moved well in front of buffing member 150. At this time, the sensor/-switch mechanism 155 signals the motive mechanism 152 to move buffing member 150, along cam track 151, toward the first extreme position 160. When this occurs the buffing member 150 will come up toward the bottom surface 159 of combination 141, pressing tail 170 therebetween, i.e. buffing tail 170 against lower surface 159, FIG. 15.

It is foreseen that a variety of specific mechanical arrangements may be utilized for: buffing member 150; cam track 151; motive mechanism 152 and the actuator mechanism including switch/sensor mechanism 155. For the embodiment of FIGS. 12–15, buffing member 150 comprises roller 165 mounted in a buffing member mount arrangement 174 such as a yoke 175, FIG. 5. The motive mechanism 152 comprises a double acting piston and cylinder arrangement 176 oriented in engagement with the yoke 175. For this embodiment, a pneumatic piston/cylinder arrangement 177 is provided. Preferably a first member 180 of the piston/cylinder arrangement 176 is pivotally mounted to a frame 181 of the apparatus 140 an anchor point 182 remote from the yoke 175, so that motion generated by cam track 151 is accommodated. This will be understood by comparison of FIGS. 12, 13, 14 and 15.

Also, preferably, the sensor/switch mechanism 155 comprises a trip switch 185, FIG. 12, provided with a sensor mechanism to sense both downward and upward motion of the trip switch 185. Preferably means, such as conventional air pressure means, provide for appropriate communication between the trip switch 185 and valve systems for firing of the piston/cylinder arrangement 176. Thus, whenever trip switch 185 is depressed, the piston/cylinder arrangement 176 is fired to direct the buffing member 150 against the lead tail 169; and, whenever the trip switch 185 is released to return to its upper position, FIG. 14, the piston/cylinder arrangement 176 is fired to direct the buffing member 150 against the rear tail of tape 170.

Figure 5:
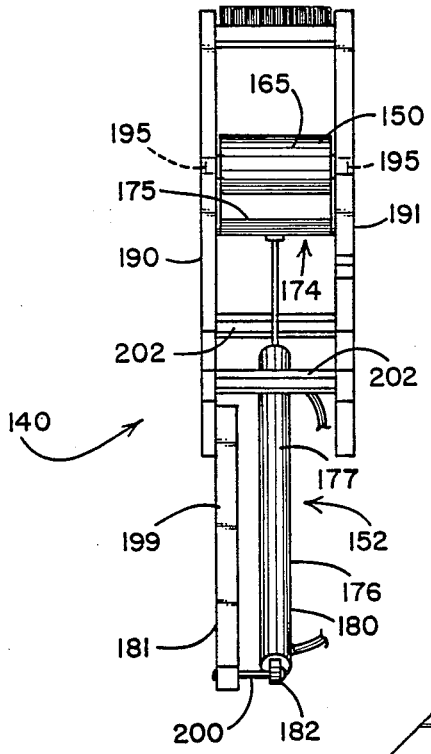
FIG. 5 is an enlarged fragmentary, end elevational view of the apparatus shown in FIG. 4.

Referring to FIGS. 4 and 5, for the embodiment described, generally the assembly 140 includes first and second opposed sidewalls 190 and 191 having opposite aligned grooves or tracks 192 and 193 therein, from which cam track arrangement 151 is formed. The yoke 175 includes opposite extensions 195 thereon, which engage tracks 192 and 193 as followers. That is, movement of buffing member 150 is, in general, for the embodiment described and shown, controlled by a cam track/follower arrangement combination.

Also preferably the arrangement 140 includes an elongate mounting extension or frame portion 199 thereon, which provides for pivotal mounting of the piston/cylinder arrangement 176 at end 182 thereof, for example by pin 200, FIG. 4. Cross-braces 202 between sidewalls 190 and 191 provide for overall structural integrity of assembly 140.

Referring to FIG. 12, air feed lines for assembly 140 are generally indicated as follows: a main trunk line 205 is shown bringing air to assembly 140 from a remote source of compressed air, not shown. Spur lines 206 and 207 provide for communication with trip switch 185, to detect motion thereof and transmit sensing of same to a valve system for operating the piston/cylinder arrangement 176. Spur lines 209 and 210 provide for selective firing of the piston/cylinder arrangement 176, for extension or retraction, respectively, of a piston member 212 thereof.

In general, assembly 140 has been described as operating in association with a tape/carton combination 141 wherein the tape has been completely applied to the carton, with lead and rear tails 169 and 170 respectively, FIG. 12. It will be understood that with appropriate timing between mechanical elements of the buffing apparatus 140, and other portions of assembly 20, FIG. 3, the lead tail 169 can be brought into contact with a buffing member 150 prior to complete formation of rear tail 170, i.e. cutting of the tape by the cutting arrangement. Thus, during initial steps of operation of a buffing device 140 according to the present invention, it is not required that the carton/tape combination 141 be completely free of a dispenser roll of tape. Rather, what is generally required is an overall system which will ensure that a free rear tail will result, prior to the second firing of mechanism 152 to provide for upward and forward movement of buffing member 150.

Still referring to FIGS. 12, 13, 14 and 15, a front brush 215 is provided in buffing apparatus 140. The brush 215 will be engaged by the buffed C-clip as the combination 141 passes thereover; and, the brush 215 will generally brush away any small pieces of extraneous material which may become adhered to the tape. The brush 215, of course, is not required for opreation of the present invention.

The assembly 140 depicted offers unique advantages over arrangements wherein at least one buffing member is fixed, (i.e. is non-moveable). In particular, both the front and rear tails 169 and 170 are handled by the same buffing member 150. With a fixed buffing member, only the lead tail can be handled, since the rear tail, with adhesive thereon, would become adhered to such a buffing member as the tape/carton combination moves through the system. Thus, a system utilizing a front, fixed, buffing roller requires a second buffing system which can accommodate the rear tail, before the rear tail engages the front, fixed, buffing member. Having more than one buffing member is less efficient and can waste space.

Another advantage to a system which utilizes a primary, moveable, buffing member such as the one of the present invention, is that a relatively rapid buffing operation is conducted. This facilitates efficient movement of cartons 21 through assembly 20 for sealing. Further, the shorter the time that tails 169 and 170 are allowed to hang free, the less likely it will be that an undesired wrinkle or crease may form therein, or that stray contaminating materials from the environment may become entrapped in the tape adhesive.

It will now be fully understood that a variety of arrangements may be utilized for formation of an assembly 20 which includes a buffing apparatus according to the present invention therein. The specific tape frame means, motive means, guide means and tape application means described and illustrated are representative only, of an arrangement suitable for utilization with such a buffing device. It is foreseen that a variety of mechanisms to accomplish such results can be provided.

It will also be understood that while the buffing device according to the present invention has been described in operation to buff front and rear tails of C-clip arrangement, alternative arrangements can be buffed. For example arrangements having front (lead) and rear tails which are not extensions of the same piece of tape could be buffed with such device. Further, cartons having more than one front tail, and more than one rear tail, could be accommodated by buffing devices having either: a single, wide, buffing member; or, a plurality of parallel positioned buffing members.

If it also noted that for the embodiment described movement of the buffing member from the second extreme position to the first extreme position is along a path exactly opposite to that used for motion from the first extreme position to the second extreme position. While forward and reverse movement along the same path may be preferred, such is not required. That is, what is generally required is cycling movement in such a manner that the front and rear tails will be appropriately engaged foı buffing, by the buffing member. It is foreseen that in general this will be accommodated by forward and reverse movement along the same path, as it is relatively simple to arrange and effect.

It has been previously discussed that the apparatus depicted in FIG. 3 is generally a modified 3M-Matic TM 22A Case Sealer. Important modifications leading to accommodation of a buffing apparatus according to the present invention have already been discussed. It is also pointed out that a conventional 22A case sealer includes means for feeding tape to both the top and bottom of a carton passing therethrough; thus, the lower tape feed apparatus has been removed to accommodate the buffing apparatus. Also, in a conventional 22A case sealer, as manufactured, positioning of the upper tape feed is such that a buffing apparatus according to the present invention cannot be readily accommodated. Therefore, for the apparatus shown in FIG. 22A the tape feed/applicator arrangement has been off-set from its usual location, so that it is upstream of the tape dispensing arrangement.

For the previous descriptions, it will be understood that a buffing apparatus according to the present invention is generally characterized as including: a buffing member; motive means from selectively moving the buffing member between first and second extreme positions along a first buffing path and a second buffing path; and, actuator means for selective activation of the motive means, when a carton is appropriately positioned in the plane of motion for buffing. For the embodiment described, the first and second buffing paths comprise opposite paths of motion between the first and second extreme positions. The first buffing path is defined such that the buffing member engages a lead tail of tape, pushing same against a bottom of a carton to be buffed, and then directing the buffing member to a retracted position. The second buffing path comprises upward movement of the buffing member toward the rear tail of tape, buffing same against the carton, and then moving the buffing member to the first extreme position for repetition of the cycle.

It will be understood that a wide variety of carton types (e.g. 1-piece, 2-piece and 3-piece) can be buffed by the apparatus.

For the embodiment described in FIGS. 4, 5 and 12-15, the apparatus includes a buffing member mount arrangement having the buffing member mounted therein, and a cam track and follower arrangement, for controlled movement of buffing member mount arrangement. Specifically, the buffing member mount arrangement comprises a yoke; and, the motive means includes a pivotally mounted piston and cylinder arrangement.

As an alternative, a link arrangement can be utilized to direct and control motion of the buffing member along the first and second paths of motion between the first and second extreme positions. An alternate embodiment illustrating such an application of a link mechanism is depicted in FIGS. 16–21. Generally, what is required is a link mechanism to which the buffing member is mounted, and which defines the appropriate paths of motion. Such a link mechanism is illustrated schematically in FIGS. 16–19, with the first extreme position being illustrated in FIG. 16 and the second extreme position being illustrated in FIG. 19.

Figure 16:
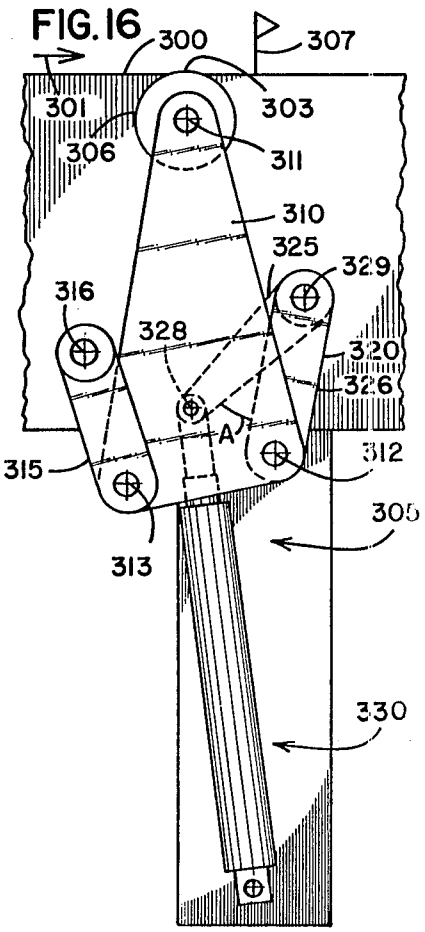
FIG. 16 is a schematic view of a portion of a buffing apparatus according to an alternate embodiment of the present invention.
Figure 17:
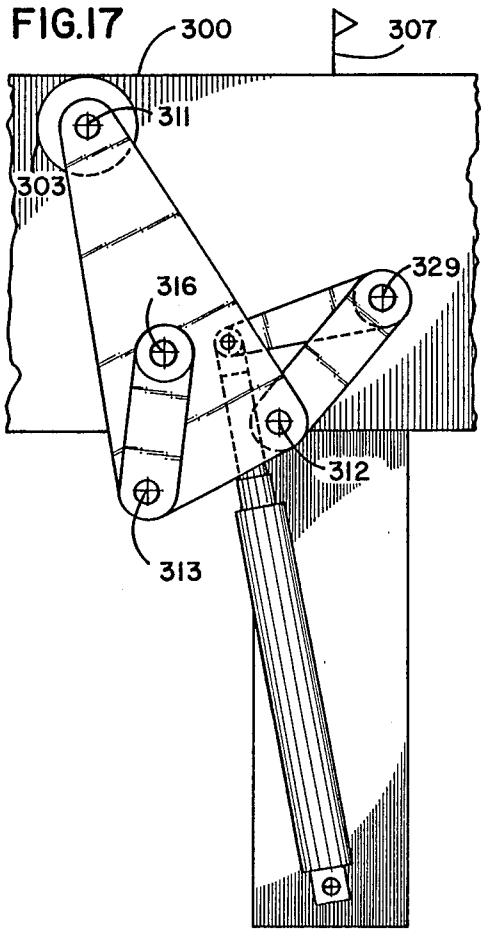
FIG. 17 is a schematic view generally analogous to that shown in FIG. 16, but illustrating progressive movement from a first extreme position to a second extreme position.
Figure 18:
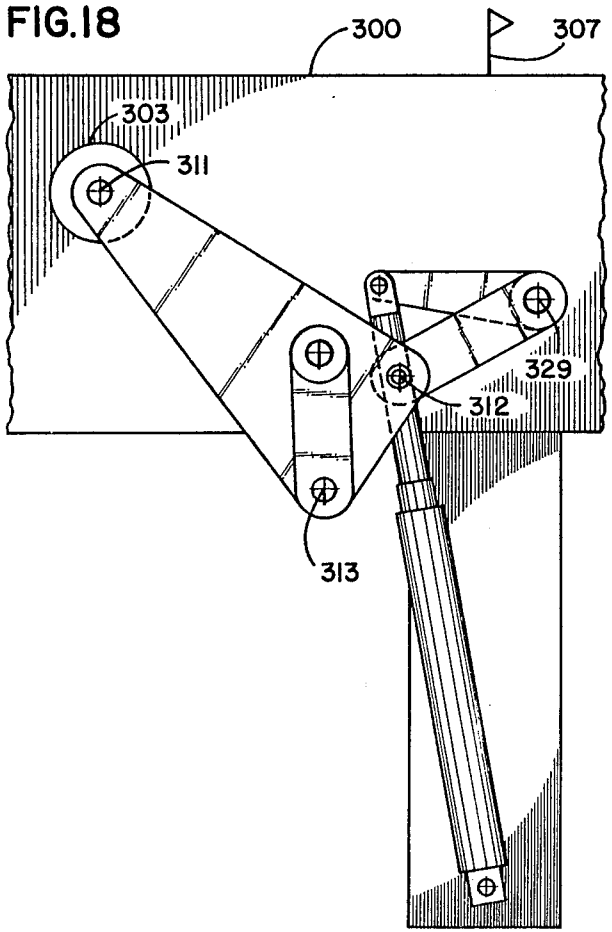
FIG. 18 is a schematic view generally analogous to those viewed shown in FIG. 16 and 17, but further indicating progression from a first extreme position to a second extreme position.
Figure 19:
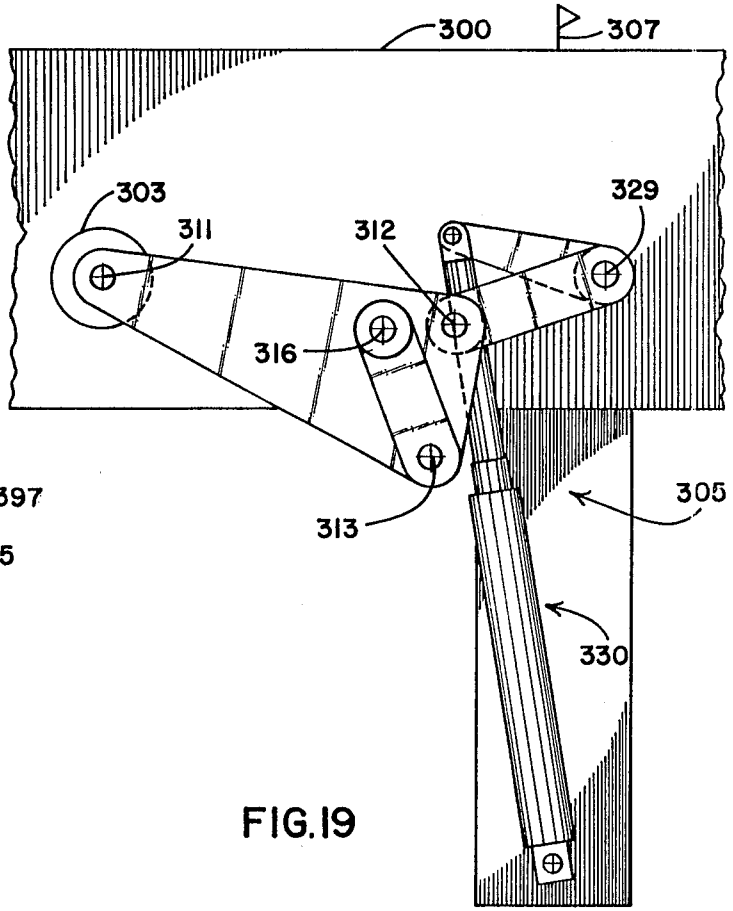
FIG. 19 is a schematic view generally analogous to that shown in FIGS. 16, 17 and 18, but further illustrating progression from a first extreme position to a second extreme position.

Referring first to FIG. 16, a plane of movement for a tape/carton arrangement having depending tails of tape is indicated generally at reference numeral 300, with motion being generally in the direction of arrow 301. A buffing member 303 is controlled by a link mechanism 305, to provide for buffing of the tape tails. For the embodiment depicted, buffing member 303 comprises a roller 306. Post 307 in FIGS. 16–19 is merely to provide a point of reference in plane 300, for comparison of the FIGS.

The particular link mechanism 305 illustrated utilizes a triangular coupler link arrangement 310 having first, second and third vertices 311, 312 and 313. Buffing member 303 is mounted at the first vertex 311.

Link arrangement 305 includes a follower link arrangement 315 pivotally mounted to vertex 313 of triangular central link 310, and also pivotally mounted at ground point 316 to a stationary frame element not shown. Operation of follower link arrangement 315, to limit or control pivotal movement of triangular coupler link 310 will be understood from below descriptions, wherein comparison of FIGS. 16, 17, 18 and 19 is made.

Finally, link mechanism 305 includes a input crank arm arrangement, which for the embodiment shown comprises an acute-angle crank arm arrangement 320; the acute-angle being defined at angle "A" FIG. 16. That is, input crank arm arrangement 320 includes a first arm portion 325 and a second arm portion 326. The second arm portion 326 is pivotally mounted on vertex 312; and, the first arm 325 is pivotally mounted to a motive mechanism at point 328. Angle "A" is the dihedral angle between arms 325 and 326. Arrangement 320 is pivotally anchored at ground point 329 to a stationary frame member.

For the embodiment depicted in FIGS. 16, 17, 18 and 19, the motive mechanism comprises a double-acting piston and cylinder arrangement 330. As the piston and cylinder arrangement 330 is extended, triangular coupler link arrangement 310 is pivoted, with control by the follower link arrangement 315 and crank arm 320 to define motion as illustrated progressively from FIGS. 16 through 17, 18 and to FIG. 19. It will be understood that the path of motion dictated by the link arrangement or mechanism 305 is such that in FIG. 16 a buffing member first extreme position is depicted, and in FIG. 19 a second extreme position for the buffing member 303 is depicted; and, movement between the two extreme positions is such that selective buffing of tape tails on a tape/carton 10 arrangement moving across plane of motion 300 in the direction of arrow 301 will occur, in a manner analogous to that described for the previous embodiments of FIGS. 12–15. Obtaining a specific defined path of motion for the buffing member 303 is generally a manner of adjusting: distance between vertices of link arrangement 310; length of follower link arrangement 305; length of the arms 325 and 326 of crank arm arrangement 320; and, the angle between arms 325 and 326. In general it will be preferred that a significant extension of horizontal movement of buffing member 303 occur adjacent the first extreme position, i.e. from FIGS. 16 to 17, so that the lead tail will be substantially buffed into position before member 303 begins to be substantially retracted. It is then desirable to utilize a link arrangement such that retraction of buffing member 303 occurs relatively rapidly, and over a short lateral distance, so it will rapidly be retracted to the second extreme position, FIG. 19. This is accomplished utilizing relative dimensions of, and angular mounting of, components as illustrated in FIGS. 16, 17, 18 and 19.

Figure 22:
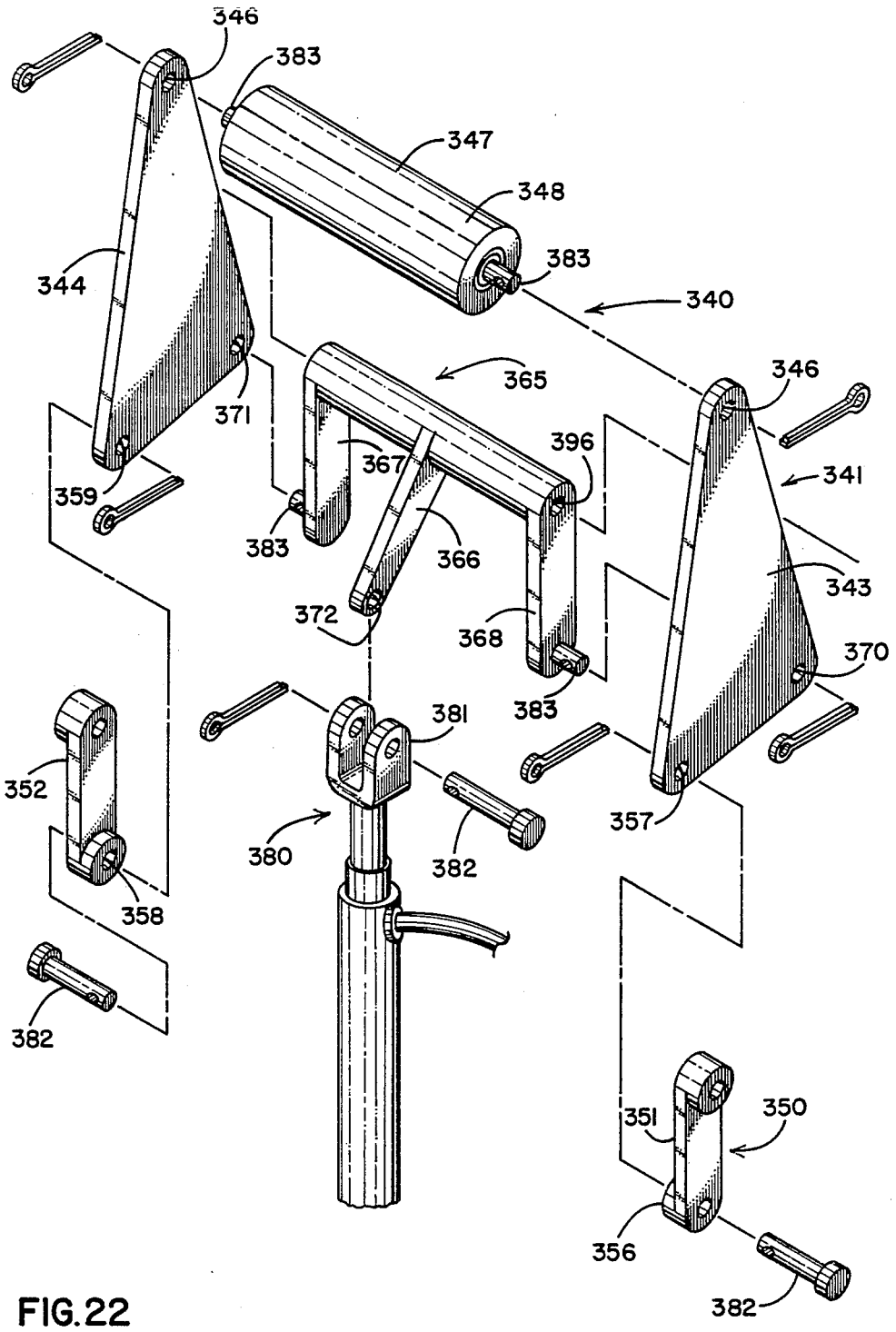
FIG. 22 is a fragmentary, exploded, perspective view of the alternate embodiment depicted in FIGS. 20 and 21.

A specific link mechanism 340 utilizing in the principles illustrated in FIGS. 16–19, is depicted in fragmentary perspective in FIG. 22. In particular, for FIG. 22 the triangular coupler link arrangement 341 comprises first and second triangular side members 343 and 344. Members 343 and 344 define a first vertex 346 across which buffing member 347 is mounted. Preferably buffing member 347 includes a rotatably mounted roller 348. The follower link arrangement 350 comprises first and second links 351 and 352 mounted substantially as mirror images of one another to extend between the triangular coupler link arrangement 341, and portions of a stationary frame for the buffing apparatus. In particular, end 356 of 351 is pivotally mounted to vertex point 357; and, end 358 of link 352 is pivotally mounted to opposite vertex point 359.

The acute-angle crank arm arrangement 365 includes a first arm extension 366 and a pair of second arm extensions 367 and 368. Acute-angle "A", FIG. 16, is the dihedral angle between first arm extension 366 and either of the second arm extensions 367 and 368.

The second arm extensions 367 and 368 are pivotally mounted to opposite third vertex points 370 and 371 on triangular coupler link arrangement 341. The first arm extension 366 is pivotally mounted at point 372, to a motive mechanism 380.

For the embodiment depicted in FIG. 22, the motive mechanism 380 comprises a double-acting piston and cylinder arrangement mounted by device 381 to link mechanism 340.

Connection between parts is indicated as accomplished by pivot shafts 382 and/or extensions 383. A variety of specific means may be used.

Figure 21:
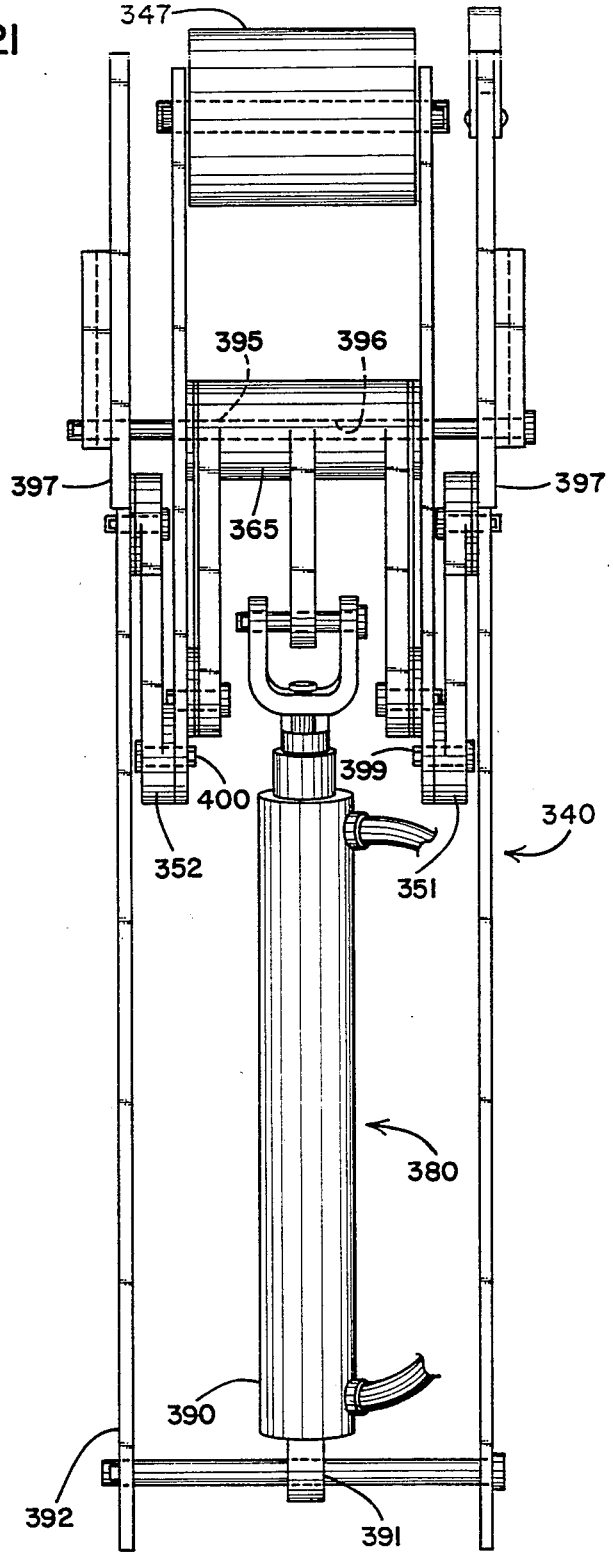
FIG. 21 is an enlarged end elevational view of a buffing apparatus according to the alternate embodiment of the present invention depicted in FIG. 20, taken generally from the perspective of line 21—21.

An end elevational view of link mechanism 340 is depicted in FIG. 21. An end 390 of piston and cylinder arrangement 380 is shown pivotally anchored at point 391, to a stationary portion 392 of frame or framework. Acute-angle crank arm arrangement 365 is mounted by axle 395, which extends through bore 396 and between sidewalls 397 and 398. Follower links 351 and 352 are mounted at pins 399 and 400.

Figure 20:
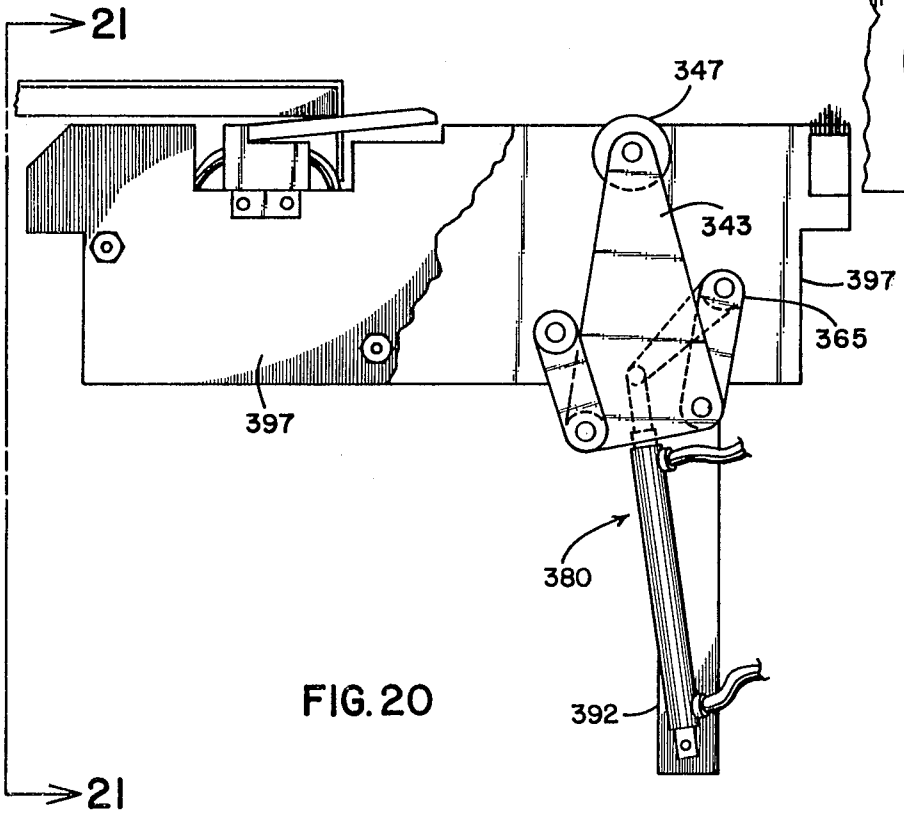
FIG. 20 is a fragmentary side elevational view of the alternate embodiment of FIGS. 16–19, with portions broken away to show detail.

Upon examination of FIGS. 21 and 22 it will be readily understood that the mechanical link mechanism 340 depicted can accommodate the motion described in FIGS. 16, 17, 18, and 19; i.e. motion of a buffing member between first and second extreme positions along first and second paths of motions as described, in order to accomplish: first buffing of a lead tail on a tape/carton combination; and, secondly, buffing of a rear tape tail on the same tape/carton combination. This is also shown in FIG. 20, a side elevational view of the arrangement of FIGS. 21 and 22. An actuator mechanism for selective firing of motive mechanism 380 may be substantially the same as that described for the previously detailed embodiments of FIGS. 4, 5 and 12–15.

Referring to FIGS. 16–19, and 22, an advantage to the mechanical link mechanism described, over the cam track/follower arrangement of FIGS. 12–15, will be understood. In particular, for the arrangement of FIGS. 12–15 the piston and cylinder arrangement is generally directed to extend a substantial distance to the side of the embodiment 140. Thus, the piston and cylinder arrangement takes up substantial lateral space in an overall carton sealing apparatus in which the buffing apparatus is mounted.

On the other hand, for the arrangement of FIGS. 16–22, the piston and cylinder arrangement may be mounted to extend generally downwardly beneath the buffing apparatus and not substantially laterally with respect thereto. Thus, substantial space saving in a carton sealing apparatus may be effected.

Further, for the link mechanism of FIGS. 16–22, relative link sizes may be chosen such that movement between the first and second extreme positions can be accomplished upon relatively little extension of the piston and cylinder arrangement. That is, a comparatively short stroke piston can be utilized to generate complete motion between the first and second extreme positions. This means that the buffing apparatus can be timed to act somewhat rapidly, with relatively rapid buffing and retraction of the buffing member. Thus, a link mechanism such as that shown may be utilized to achieve a relatively fast buffing operation.

Further, and as will be understood from examination of FIGS. 16–19, in moving the buffing member from the first extreme position to the second extreme position, once the stretch of relatively horizontal movement of the buffing member is accomplished, the link mechanism illustrated generates a downwardly curved, and rapidly sinking path of recession or retraction of the buffing member. Thus, less overall lateral movement of the buffing member can result than with the embodiment of FIGS. 12–15, and space is conserved.

The link mechanism of FIGS. 16–22 has been described as selectively actuated by means of trip switch mechanism analogous to that used for FIGS. 12–15. It will be understood that a variety of alternate arrangements may be utilized. For example, instead of a piston and cylinder arrangement, an extension can be utilized in association with crank arm 320, which extension is engaged by a carton moving across the buffing apparatus so that the carton itself directly causes pivotal movement of the crank arm 320, and thus operation of the link mechanism.

It is foreseen that for many applications a link mechanism actuated by means of a sensor/switch system analogous that shown in FIGS. 12–15 it will be preferred, over a system actuated by means of a link member engaged by a moving carton. At least one reason for this is that interruption carton motion will be less likely, for many applications. Further, carton size will be a less important variable.

Also according to the present invention a method of buffing lead and rear tape tails to a tape/carton arrangement is provided. The method generally involves: providing a buffing member; moving the buffing member against the lead tail to buff same against the carton and then retracting the buffing member beneath the rear tail; passing the carton beyond the retracted buffing member; and, moving the buffing member upwardly toward the rear tape tail, to buff same against the carton. Preferably, 10 application of the method involves a step of continuously moving the carton throughout the buffing operation.

It is to be understood that while certain embodiments of the present invention have been illustrated and described, is not be limited to the specific forms or arrangement of parts herein described and shown.

What is claimed is:

1. A buffing apparatus for buffing lead and rear depending tails against an underside of a carton moving in a first plane of motion; said buffing apparatus comprising:
   (a) a single, depending tail, buffing member;
   (b) motive means for selectively moving said buffing member between first and second extreme positions along a first buffing path and a second buffing path;
      (i) said first buffing path comprising a path of motion directing said single, depending tail, buffing member first against the lead depending tail to buff same against the underside of the moving carton, and then to retract said single, depending tail, buffing member downwardly to a position beneath the rear depending tape tail;
      (ii) said second buffing path comprising a path of motion directing said single, depending tail, buffing member first upwardly toward the carton plane of motion, then against the rear depending tape tail to buff same against the underside of the moving carton; and,
   (c) actuator means for selective actuation of said motive means as the carton is appropriately positioned in the plane of motion, for buffing.

2. An apparatus according to claim 1 wherein the buffing member comprises a roller.

3. An apparatus according to claim 1 wherein:
   (a) said apparatus includes a buffing member mount arrangement having a follower mechanism thereon; said buffing member being mounted in said mount arrangement;
   (b) said apparatus includes a cam track arrangement defining said first and second buffing paths; said follower mechanism being constructed and arranged to engage said cam track and restrict motion of said mount arrangement and buffing member to paths of motion defined thereby; and,
   (c) said motive means includes a motive mechanism constructed and arranged to selectively move said mount arrangement and said buffing member along said paths defined by said cam track.

4. An apparatus according to claim 3 wherein:
   (a) said buffing member mount arrangement comprises a yoke;
   (b) said buffing member comprises a roller; and,
   (c) said cam track arrangement comprises first and second opposite sidewalls, each having a cam track groove therein.

5. An apparatus according to claim 4 wherein:
   (a) said follower mechanism comprises first and second opposite projections on said yoke, each of said opposite projections engaging a respective one of said cam track grooves in one each of said opposite sidewalls; and,
   (b) said motive mechanism includes a double-acting piston and cylinder arrangement mounted to extend between a pivotable anchor point and said yoke.

6. An apparatus according to claim 3 wherein:
   (a) said cam track arrangement includes a forward cam track portion and a rearward cam track portion;
      (i) said forward cam track portion being generally aligned with the first plane of motion; and,
      (ii) said rearward cam track portion being substantially depending from said forward cam track portion.

7. An apparatus according to claim 1 wherein said first and second buffing paths comprise identical, but opposite, paths of motion for said buffing member.

8. An apparatus according to claim 1 wherein said actuator means includes a sensor/switch mechanism positioned in the first plane of motion for engagement by the carbon moving therein; said sensor/switch mechanism including means for sensing when a carton is appropriately positioned for activation of said motive means; and, said sensor/switch mechanism including means for activating said motive means.

9. A buffing apparatus according to claim 1 wherein said motive means includes a link mechanism having said buffing member mounted thereon; said link mechanism defining said first and second buffing paths.

10. A buffing apparatus according to claim 9 wherein said motive means includes a double-acting piston and cylinder arrangement mounted in operative extension between an anchor point and said link mechanism.

11. A carton sealing apparatus comprising:
   (a) a frame arrangement;
   (b) motive means for moving cartons to be buffed through the frame arrangement in a first plane of motion;

(c) guide means for directing cartons to be buffed through the arrangement;

(d) tape application means for applying tape to a carton passing through said frame arrangement in a manner creating lead and rear depending tape tails attached to and depending from the carton; and (e) a buffing apparatus for buffing lead and rear depending tape tails against an underside of a carton mounted in said frame arrangement and including: a single, depending tail, buffing member, a buffing member motive mechanism, and, actuator means, (i) said buffing member motive mechanism including means for selectively moving said single, depending tail, buffing member between first and second extreme positions along a first buffing path and a second buffing path; said first buffing path comprising a path of motion directing said single, depending tail, buffing member first against the lead depending tail to buff same against the underside of the moving carton, and then to retract said single, depending tail, buffing member beneath the rear depending tape tail; said second buffing path comprising a path of motion directing said single, depending tail, buffing member first upwardly toward the carton plane of motion, then against the rear depending tape tail to buff same against the underside of the moving carton; and, (ii) said actuator means including means for selective actuation of said buffing member motive mechanism as the carton is appropriately positioned in the plane of motion, for buffing.

12. An apparatus according to claim 11 wherein the buffing member comprises a roller.

13. An apparatus according to claim 11 wherein:

(a) said apparatus includes a buffing member mount arrangement having a follower mechanism thereon; said buffing member being mounted in said mount arrangement;

(b) said apparatus includes a cam track arrangement defining said first and second buffing paths; said follower mechanism being constructed and arranged to engage said cam track and restrict motion of said mount arrangement and buffing member to paths of motion defined thereby; and, (c) said buffing member motive mechanism being constructed and arranged to selectively move said mount arrangement and said buffing member along said paths defined by said cam track.

14. An apparatus according to claim 13 wherein:

(a) said buffing member mount arrangement comprises a yoke;

(b) said buffing member comprises a roller; and, (c) said cam track arrangement comprises first and second opposite sidewalls, each having a cam track groove therein.

15. An apparatus according to claim 14 wherein:

(a) said follower mechanism comprises first and second opposite projections on said yoke, each of said opposite projections engaging a respective one of said cam track grooves in one each of said opposite sidewalls; and, (b) said buffing member motive mechanism includes a double-acting piston and cylinder arrangement mounted to extend between a pivotable anchor point and said yoke.

16. An apparatus according to claim 13 wherein:

(a) said cam track arrangement includes a forward cam track portion and a rearward cam track portion;

(i) said forward cam track portion being generally aligned with the first plane of motion; and, (ii) said rearward cam track portion being substantially depending from said forward cam track portion.

17. A buffing apparatus for buffing lead and rear depending tape tails against a carton moving in a first plane of motion; said buffing apparatus comprising:

(a) a buffing member;

(b) motive means for selectively moving said buffing member between first and second extreme positions along a first buffing path and a second buffing path;

(i) said first buffing path comprising a path of motion directing said buffing member first against the lead tail to buff same against the moving carton, and then to retract said buffing member beneath the rear tape tail;

(ii) said second buffing path comprising a path of motion directing said buffing member first upwardly toward the carton plane of motion, then against the rear tape tail to buff same against the moving carton;

(iii) said first and second buffing paths comprising identical, but opposite, paths of motion for said buffing member; and, (c) actuator means for selective actuation of said motion means as the carton is appropriately positioned in the plane of motion, for buffing.

18. An apparatus according to claim 24 wherein the buffing member comprises a roller.

19. An apparatus according to claim 24 wherein said actuator means includes a sensor/switch mechanism positioned in the first plane of motion for engagement by the carton moving therein; said sensor/switch mechanism including means for sensing when a carton is appropriately positioned for activation of said motive means; and, said sensor/switch mechanism including means for activating said motive means.

20. A buffing apparatus according to claim 17 wherein said motive means includes a link mechanism having said buffing member mounted therein; said link mechanism defining said first and second buffing paths.

21. An apparatus according to claim 20 wherein:

(a) said apparatus includes a stationary frame;

(b) said link mechanism includes a triangular coupler link arrangement having said buffing member mounted at a first vertex of said triangular coupler link arrangement;

(c) said link mechanism includes a follower link arrangement pivotally mounted to extend between a second vertex of said triangular coupler link arrangement and a portion of said stationary frame; and, (d) said link mechanism includes an input crank arm arrangement pivotally mounted to a third vertex of said triangular coupler link arrangement; said triangular coupler link arrangement, follower link arrangement and input crank arm arrangement cooperatively defining said first and second buffing paths.

22. An apparatus according to claim 21 wherein:

(a) said triangular coupler link arrangement includes first and second opposite, spaced, triangular side member; and, (b) said buffing member comprises a roller positioned between said triangular side members.

23. A buffing apparatus for buffing lead and rear depending tape tails against a carton moving in a first plane of motion; said buffing apparatus comprising:

(a) a stationary frame;

(b) a buffing member;

(c) motive means for selectively moving said buffing member between first and second extreme positions along a first buffing path and a second buffing path; said motive means including a link mechanism having said buffing member mounted thereon; said link mechanism defining said first and second buffing paths;

(i) said first buffing path comprising a path of motion directing said buffing member first against the lead tail to buff same against the moving carton, and then to retract said buffing member beneath the rear tape tail;

(ii) said second buffing path comprising a path of motion directing said buffing member first upwardly toward the carton plane of motion, then against the rear tape tail to buff same against the moving carton;

(iii) said link mechanism including a triangular coupler link arrangement having said buffing member mounted at a first vertex of said triangular coupler link arrangements;

(iv) said link mechanism including a follower link arrangement pivotally mounted to extend between a second vertex of said triangular coupler link arrangement and a portion of said stationary frame; and (v) said link mechanism including an input crank arm arrangement pivotally mounted to a third vertex of said triangular coupler link arrangement; said triangular coupler link arrangement, follower link arrangement and input crank arm arrangement cooperatively defining said first and second buffing paths; and, (d) actuator means for selective actuation of said motion means as the carton is appropriately positioned in the plane of motion, for buffing.

24. A buffing apparatus according to claim 23 wherein: said motive means includes a double-acting piston and cylinder arrangement mounted in operative extension between an anchor point on said stationary frame, and said crank arm arrangement.

25. An apparatus according to claim 23 wherein:

(a) said triangular coupler link arrangement includes first and second opposite, spaced, triangular side members; and, (b) said buffing member comprises a roller positioned between said triangular side members.

26. An apparatus according to claim 23 wherein the buffing member comprises a roller.

27. An apparatus according to claim 23 wherein said first and second buffing paths comprise identical, but opposite, paths of motion for said buffing member.

28. An apparatus according to claim 23 wherein said actuator means includes a sensor/switch mechanism positioned in the first plane of motion for engagement by the carton moving therein; said sensor/switch mechanism including means for sensing when a carton is appropriate positioned for activation of said motive means; and, said sensor/switch mechanism including means for activating said motive means.

29. A carton sealing apparatus comprising:

(a) a frame arrangement;

(b) motive means for moving cartons to be buffed through the frame arrangement in a first plane of motion;

(c) guide means for directing cartons to be buffed through the arrangement;

(d) tape application means for applying tape to a carton passing through said frame arrangement in a manner creating lead and rear depending tape tails on the carton; and (e) a buffing apparatus mounted in said frame arrangement and including: a buffing member, a buffing member motive mechanism, and, actuator means, (i) said buffing member motive mechanism including means for selectively moving said buffing member between first and second extreme positions along a first buffing path and a second buffing path; said first buffing path comprising a path of motion directing said buffing member first against the lead tail to buff same against the moving carton, and then to retract said buffing member beneath the rear tape tail; said second buffing path comprising a path of motion directing said buffing member first upwardly toward the carton plane of motion, then against the rear tape tail to buff same against the moving carton;

(ii) said first and second buffing paths defining identical, but opposite, paths of motion for said buffing member; and, (iii) said actuator means including means for selective actuation of said buffing member motive mechanism as the carton is appropriately positioned in the plane of motion, for buffing.

30. An apparatus according to claim 17 wherein the buffing member comprises a roller.

31. A buffing apparatus according to claim 29 wherein said motive means including a link mechanism having said buffing member mounted thereon; said link mechanism defining said first and second buffing paths.

32. An apparatus according to claim 31 wherein:

(a) said link member includes a triangular coupler link arrangement having said buffing member mounted at a first vertex of said triangular coupler link arrangement;

(b) said link mechanism includes a follower link arrangement pivotally mounted to extend between a second vertex of said triangular coupler link arrangement and a portion of stationary frame; and, (c) said link mechanism includes an input crank arm arrangement pivotally mounted to a third vertex of said triangular coupler link arrangement.

33. A method of buffing lead and rear depending tails of tape against a bottom side of a carton moving in a first plane; said method including the steps of:

(a) providing a buffing member;

(b) moving said buffing member along a first path of motion against the load tail to buff same against the bottom side of the carton and then to retract the buffing member beneath the rear tail;

(c) following said step (b), passing the carton at least partially over the retracted buffing member; and, (d) following said step (c), moving said buffing member along a second path of motion upwardly toward the rear tape tail to buff same against the carton bottom side;

(i) said first and second paths of motion comprising identical, but opposite, paths of motion.

34. A method according to claim 33 including a step of continuously moving the carton throughout the buffing operation.

* * * * *

UNITED STATES PATENT AND TRADEMARK OFFICE
CERTIFICATE OF CORRECTION

PATENT NO. : 4,875,895

DATED : October 24, 1989

INVENTOR(S) : James A. Donnay; Van E. Jensen, Jr.; Byron S. Kruzel

It is certified that error appears in the above-identified patent and that said Letters Patent is hereby corrected as shown below: ON TITLE PAGE:

No. [73] "Manufcturing" should be --Manufacturing--

No. [73] After "Manufacturing" insert --Company--

Abstract, line 5 after "between" insert --first and second extreme positions, along first and second--

Column 1, line 53 "Corporation" should be --Company--

Column 4, line 6, "prefered" should be --preferred--

Column 4, line 9, "thrid" should be --third--

Column 5, line 29 "FIG" should be --FIGS--

Column 5, line 57 after "in" insert --the--.

Column 8, line 5 "3-Matic" should be --3M-Matic--

Column 9, line 5, "vary" should be --very--

Column 9, line 34 after "will" insert --be--

Column 10, line 10 after "generally" insert --by--

UNITED STATES PATENT AND TRADEMARK OFFICE
CERTIFICATE OF CORRECTION

PATENT NO. : 4,875,895

DATED : October 24, 1989

INVENTOR(S) : James A. Donnay; Van E. Jensen, Jr; Byron S. Kruzel

It is certified that error appears in the above-identified patent and that said Letters Patent is hereby corrected as shown below:

Column 11, line 31 "provided" should be --provide--

Column 12, line 62 "opreation" should be --operation--

Column 15, line 1 "a" should be --an--

Column 17, line 35 delete "10"

Column 17, line 40 "is not be" should be --it is not to be--

Column 20, claims 18 and 19, "24" should be --17--

Column 21, line 64, "appropriate" should be --approprieately--

Column 22, line 54, "load" should be --lead--

Signed and Sealed this

Thirteenth Day of August, 1991

*Attest:*

HARRY F. MANBECK, JR.

*Attesting Officer*

*Commissioner of Patents and Trademarks*